US009623419B2

(12) United States Patent
Dallimore et al.

(10) Patent No.: US 9,623,419 B2
(45) Date of Patent: Apr. 18, 2017

(54) WEAR TIP HOLDER FOR VSI CRUSHER, AND METHOD OF REDUCING WEAR OF VSI CRUSHER ROTOR

(75) Inventors: Rowan Dallimore, Somerset (GB); Knut Kjaerran, Svedala (SE); Andreas Forsberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/346,334

(22) PCT Filed: Aug. 29, 2012

(86) PCT No.: PCT/EP2012/066747
§ 371 (c)(1),
(2), (4) Date: Mar. 21, 2014

(87) PCT Pub. No.: WO2013/041334
PCT Pub. Date: Mar. 28, 2013

(65) Prior Publication Data

US 2014/0217210 A1 Aug. 7, 2014

(30) Foreign Application Priority Data

Sep. 23, 2011 (EP) ..... 11182569

(51) Int. Cl.
*B02C 13/28* (2006.01)
*B02C 18/18* (2006.01)
*B02C 13/18* (2006.01)

(52) U.S. Cl.
CPC ..... *B02C 13/28* (2013.01); *B02C 13/1835* (2013.01); *B02C 13/1842* (2013.01); *B02C 13/2804* (2013.01)

(58) Field of Classification Search
CPC ..... B02C 13/1842; B02C 13/2804; B02C 13/1814; B02C 13/1835; B02C 2/10; B02C 13/095
USPC ..... 241/275, 294, 300, 226
See application file for complete search history.

(56) References Cited

U.S. PATENT DOCUMENTS

| | | | | |
|---|---|---|---|---|
| 3,895,982 | A * | 7/1975 | Persson | 156/71 |
| 4,940,188 | A * | 7/1990 | Rodriguez et al. | 241/275 |
| 5,029,761 | A * | 7/1991 | Bechler | 241/275 |
| 5,954,282 | A * | 9/1999 | Britzke et al. | 241/275 |
| 7,257,876 | B2 * | 8/2007 | Dallimore | 29/464 |
| 7,530,512 | B2 * | 5/2009 | Dallimore et al. | 241/274 |

(Continued)

FOREIGN PATENT DOCUMENTS

WO 2004020100 A1 3/2004

*Primary Examiner* — Faye Francis
*Assistant Examiner* — Onekki Jolly
(74) *Attorney, Agent, or Firm* — Corinne R. Gorski

(57) ABSTRACT

A wear tip holder for holding a wear tip adjacent to an outflow opening of a vertical rotor wall of a rotor of a VSI crusher includes a mounting plate for mounting the wear tip holder to the rotor wall. The mounting plate has a mounting face for facing a segment of the rotor wall to which it is to be mounted and a wear face, opposite the mounting face, for facing the interior of the rotor. A side wall extends between the mounting face and the wear face. The side wall includes a material retention surface facing, when in use, the rotor wall segment, thereby allowing material to be trapped under the material retention face.

12 Claims, 9 Drawing Sheets

(56) References Cited

U.S. PATENT DOCUMENTS

| | | | | |
|---|---|---|---|---|
| 2003/0025020 | A1* | 2/2003 | Britzke | 241/275 |
| 2003/0213861 | A1* | 11/2003 | Condon et al. | 241/275 |

* cited by examiner

WEAR TIP HOLDER FOR VSI CRUSHER, AND METHOD OF REDUCING WEAR OF VSI CRUSHER ROTOR

RELATED APPLICATION DATA

This application is a §371 National Stage Application of PCT International Application No. PCT/EP2012/066747 filed Aug. 29, 2012 claiming priority of EP Application No. 11182569.1, filed Sep. 23, 2011.

FIELD OF THE INVENTION

The present invention relates to a wear tip holder for holding a wear tip adjacent to an outflow opening of a vertical rotor wall of a rotor of a VSI crusher. The invention also relates to a method of reducing the wear rate of such a rotor.

BACKGROUND OF THE INVENTION

Vertical shaft impact crushers (VSI crushers) are used in many applications for crushing hard material, such as rocks, ore etc. A VSI crusher comprises a housing and a horizontal rotor located inside the housing. WO 2008133568 (A1) discloses an example of a rotor of a VSI crusher. Material that is to be crushed is vertically fed into the rotor, and with the aid of centrifugal force the rotating rotor ejects the material against the inner wall of the housing. On impact with the wall of the housing the material is crushed to a desired size. The housing wall could be provided with anvils or have a bed of retained material against which the accelerated material is crushed.

The rotor of a VSI crusher usually has a horizontal upper disc and a horizontal lower disc. The upper disc has an aperture for feeding material to be crushed into the rotor, such that the material lands on the lower disc. The upper and lower discs are interconnected by a vertical rotor wall, which guides the material to material outflow openings about the circumference of the rotor. The vertical rotor wall of WO 2008133568 is provided with a number of wear tips adjacent to the outflow openings in the rotor wall, to protect the rotor wall from wear caused by the material leaving the rotor at a high speed. The wear tips are provided with air flow directing ridges for reducing the wear of the wear tips and the rotor wall.

When the wear tips have become worn out they must be replaced. Replacement of the wear parts requires the VSI crusher to be shut down for a considerable time for maintenance.

SUMMARY OF THE INVENTION

It is an object of the present invention to solve, or at least mitigate, parts or all of the above mentioned problems. To this end, there is provided a wear tip holder for holding a wear tip adjacent to an outflow opening of a vertical rotor wall of a rotor of a VSI crusher, said wear tip holder comprising a mounting plate for mounting the wear tip holder to said rotor wall, the mounting plate having a mounting face for facing a segment of the rotor wall to which it is to be mounted; a wear face, opposite to the mounting face, for facing the interior of the rotor; and a side wall extending between said mounting face and said wear face, the side wall comprising a material retention surface facing, when in use, said rotor wall segment, thereby allowing material to be trapped under the material retention face.

When such a wear tip holder is used in a VSI crusher, material to be crushed may become trapped between the material retention surface and the rotor wall, or between the material retention surface and another portion of the side wall, as the case may be. The trapped material will assist in forming and maintaining a bed of material on the rotor wall, such that the wear of the rotor wall will be reduced. The bed of material will also reduce the wear of the wear tip holder and the wear tip. As a consequence, an increase of the service interval of the crusher may be allowed.

According to an embodiment, at least a portion of the material retention surface is shaped as a chamfering of the side wall. Such an embodiment is easy to fabricate and resistant to wear.

According to an embodiment, at least a portion of the material retention surface forms an angle of more than 100° with the mounting face. Such an angle provides for an increased ability of the material retention surface to trap and retain material to be crushed.

According to an embodiment, at least a portion of the material retention surface is adapted to form, together with the rotor wall segment, a recess having a depth exceeding 10 mm. Such a depth provides for an increased ability of the material retention surface to trap and retain material to be crushed.

According to an embodiment, at least a portion of the material retention surface is shaped as a shoulder extending from the side wall. According to an embodiment, the material retention surface extends along at least ⅓ of the length of the side wall. Such a length provides for an increased ability of the material retention surface to trap and retain material to be crushed.

According to an embodiment, at least a portion of the material retention surface extends over at least ⅓ of the height of the side wall. This provides for an increased ability of the material retention surface to trap and retain material to be crushed.

According to an embodiment, at least a portion of the material retention surface extends to less than 80% of the height of the side wall. Thereby, the integrity of the wear face is maintained, so as to make the wear tip holder more resistant to wear.

According to an embodiment, the material retention surface is shaped so as to, when in use, directly face the rotor wall segment. Such a wear tip holder is relatively simple to fabricate, while offering a high material trapping capability.

According to an embodiment, the side wall comprises three essentially straight side wall segments, each side wall segment being provided with a material retention surface for facing the rotor wall segment.

According to an embodiment, the area of the wear face is at least 3% larger than the area of the mounting face. This provides for an increased ability of the material retention surface to trap and retain material to be crushed.

According to an embodiment, the mounting plate is provided with a fastening arrangement for fastening the wear tip holder to the rotor wall, the fastening arrangement being located at an unchamfered portion of the side wall. Such a design provides for a maximum of strength of the fastening arrangement.

According to another aspect of the invention, parts or all of the above mentioned problems are solved, or at least mitigated, by a method of decreasing the wear rate of a rotor of a VSI crusher, said rotor comprising a wear tip holder mounted to a rotor wall by means of a mounting plate having a wear face and, opposite to the wear face, a mounting face facing a rotor wall segment, the method comprising trapping material to be crushed between the rotor wall segment and a material retention surface, arranged at a side wall of the mounting plate, and facing the rotor wall segment. Thereby, the trapped material to be crushed will at least partly protect the rotor from wear.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE EXEMPLARY EMBODIMENTS

Figure 1:
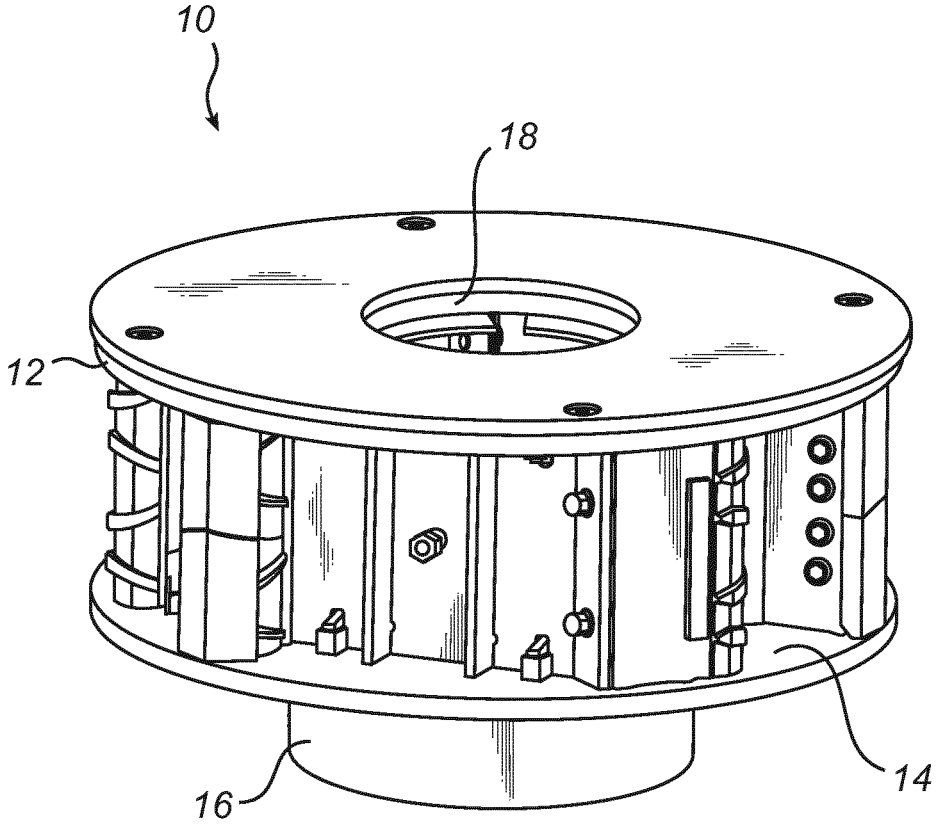
FIG. 1 is a three-dimensional view and shows a rotor for a VSI crusher.

FIG. 1 shows a rotor 10 for use in a Vertical Shaft Impact Crusher, i.e., a VSI crusher. The rotor 10 has a roof in the form of a horizontal upper disc 12, and a floor in the form of a horizontal lower disc 14. The lower disc 14 has a hub 16, which is welded to the disc 14. The hub 16 is to be connected to a shaft (not shown) for rotating the rotor 10 inside the housing of a VSI crusher. The upper disc 12 has a central aperture 18 through which material to be crushed can be fed into the rotor 10.

Figure 2:
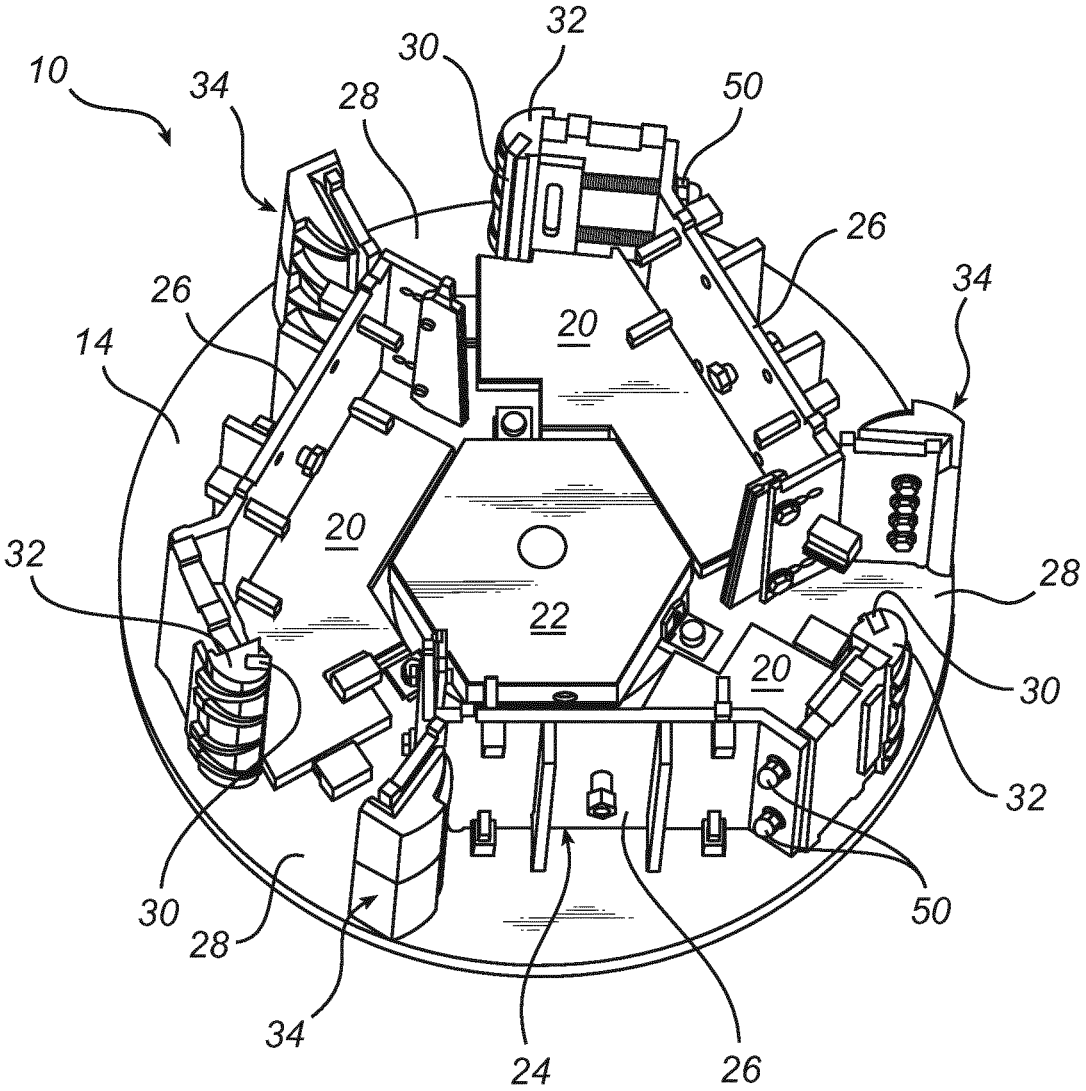
FIG. 2 is a three-dimensional view and shows the rotor of FIG. 1 with the upper disc removed.

As is shown in FIG. 2 the lower disc 14 is protected from wear by lower wear plates 20. A distributor plate 22 is fastened to the centre of the lower disc 14. The distributor plate 22 distributes the material that is fed via the aperture 18 in the upper disc 12 (FIG. 1).

The upper and lower discs 12, 14 are separated by and held together by a vertical rotor wall arrangement 24, which is separated into three separate rotor walls 26. Gaps between the rotor walls 26 define outflow openings 28, through which material may be ejected against a housing wall (not shown). At each outflow opening 28 the respective rotor wall 26 is protected from wear by a wear tip 30 located at the leading edge of the respective rotor wall 26. Each wear tip 30 is mounted to the respective rotor wall 26 by means of a wear tip holder 32, which will be described further below. Each rotor wall 26 is also provided with a respective pair 34 of cavity wear plates, which protect the rotor 10 and in particular the wear tips 30 from material rebounding from the housing wall and from ejected material and airborne fine dust spinning around the rotor 10.

Figure 3:
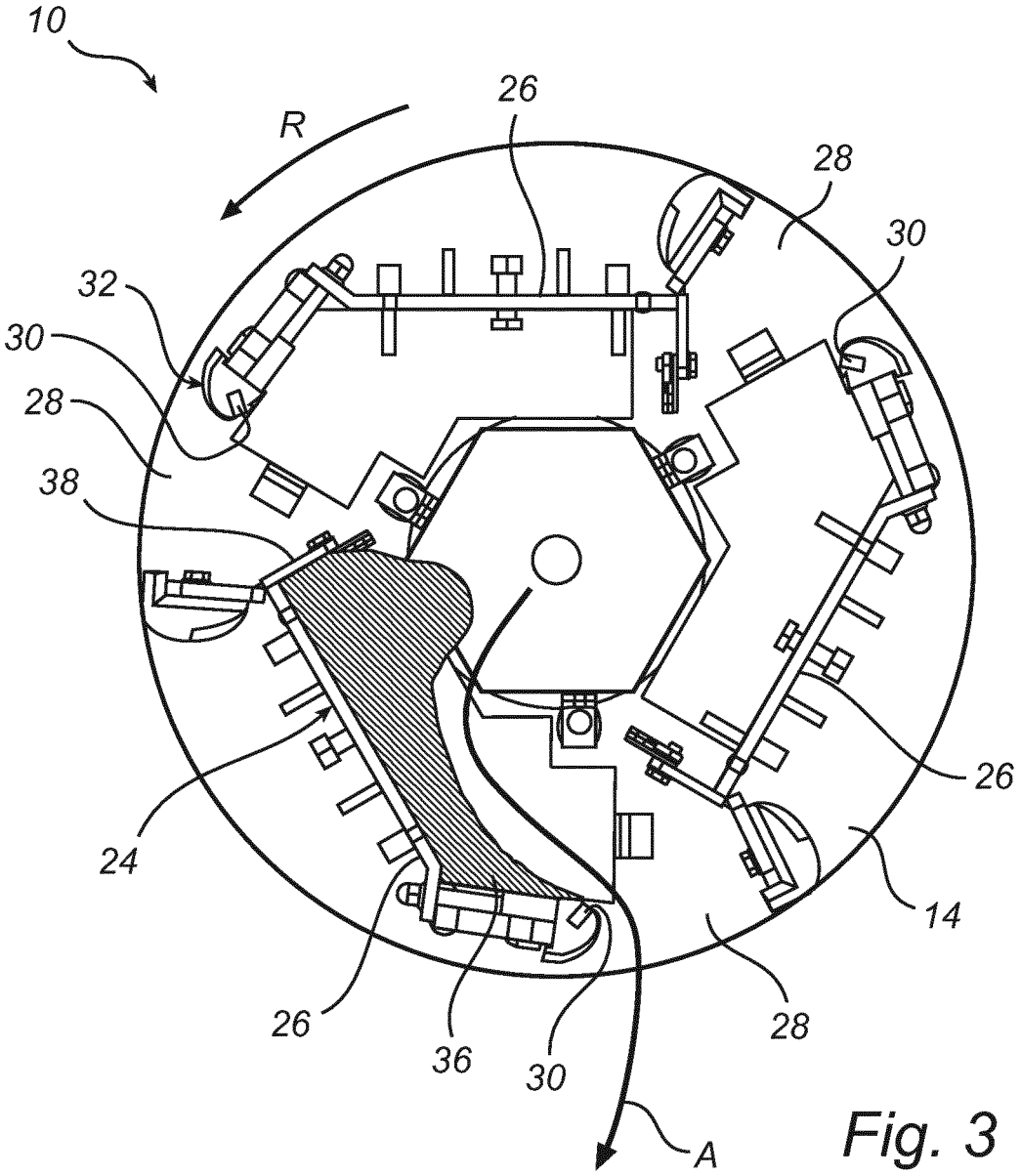
FIG. 3 shows the rotor of FIG. 2 as seen from above in a two dimensional perspective.

FIG. 3 illustrates the rotor 10 as seen from above and in operation. The upper disc 12 is not shown in FIG. 3 for reasons of clarity. The arrow R indicates the rotational direction of the rotor 10 during operation of the VSI crusher. During operation of the rotor 10 a bed 36 of material is built up inside the rotor 10 against each of the three rotor walls 26. In FIG. 3 only the bed 36 located adjacent to one of the rotor walls 26 is shown. The bed 36, which consists of material that has been fed to the rotor 10 and then has been trapped inside it, extends from a rear support plate 38 to the wear tip 30. The bed 36 protects the rotor wall 26 and the wear tip 30 from wear and provides a proper direction to the ejected material. The bed 36 of material forms an autogenous wear surface, which is regenerated as more material is fed into the crusher. The arrow A describes a typical passage of a piece of rock fed to the rotor 10 via the central aperture 18 and ejected via an outflow opening 28.

Figure 4A:
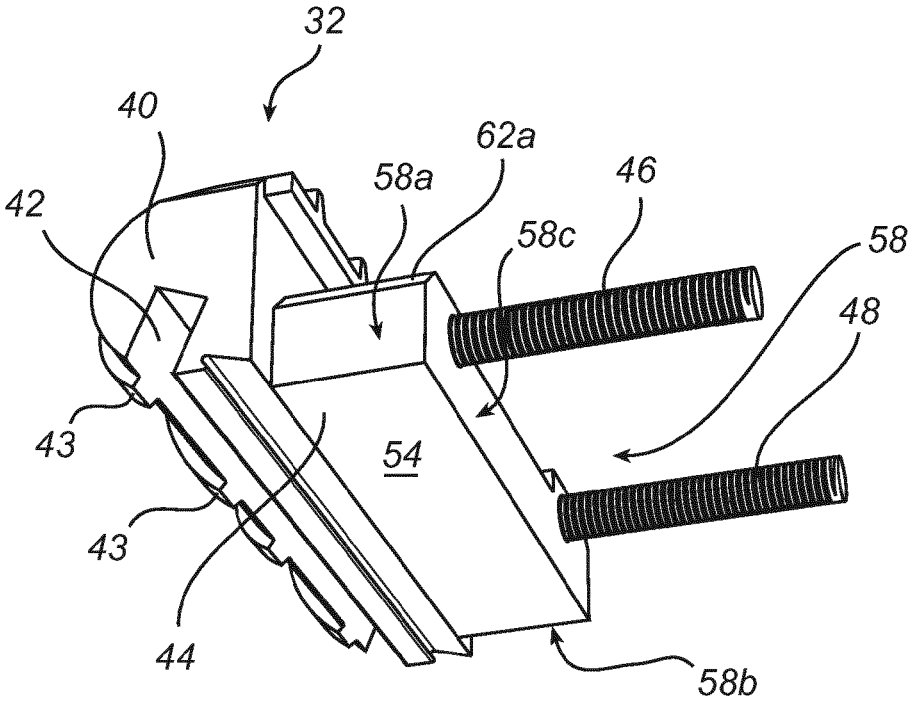
FIG. 4*a* is a three-dimensional view of a wear tip holder according to a first embodiment.
Figure 4B:
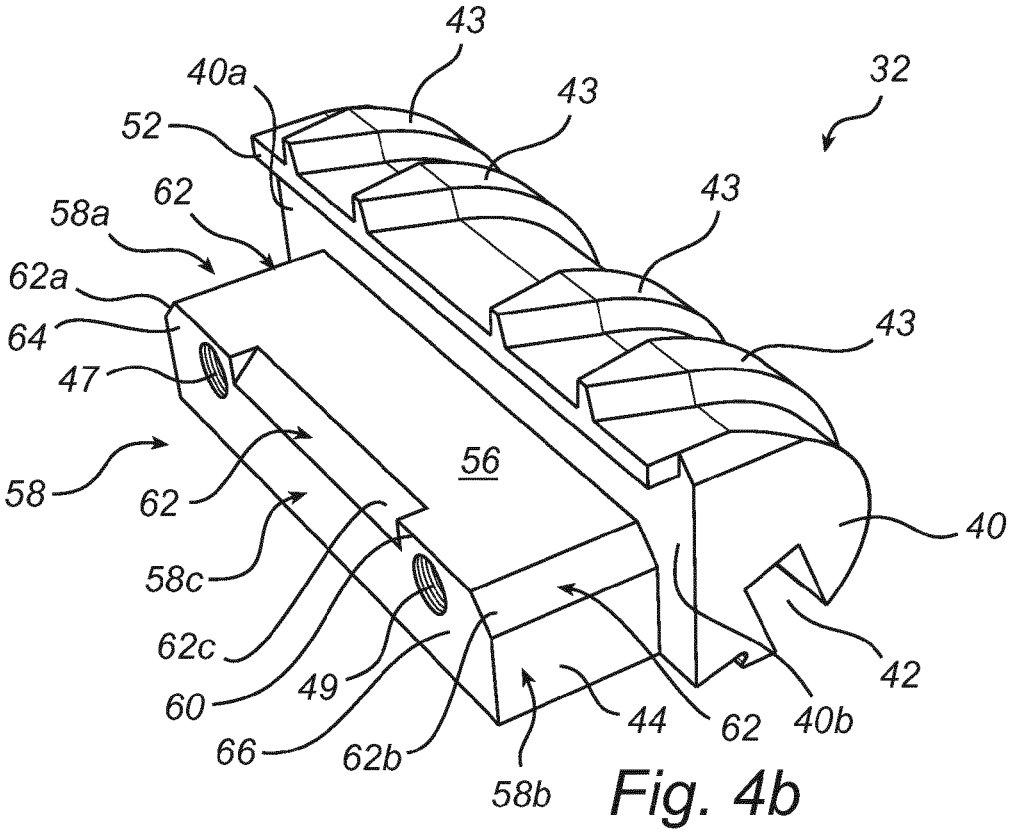
FIG. 4*b* is a further three-dimensional view of the wear tip holder of FIG. 4*a;*

FIGS. 4*a* and 4*b* illustrate a first embodiment of a wear tip holder 32. The wear tip holder 32 has a wear body 40 with an elongate recess 42, in which the wear tip 30 (FIG. 2) is to be located. The wear tip 30, which typically comprises a hard material such as tungsten carbide, may, by way of example, be welded or glued to the wear body 40. Ridges 43 extend across the wear body 40, and serve for forming an irregular turbulent air flow adjacent to the wear tip 30 in the manner described in greater detail in WO 2008/133568, such that the abrasive effect of dust laden air flowing past the wear tip 30 will be minimized.

A mounting plate 44, which is a flat, rectangular plate for mounting the wear tip holder 32 to the vertical wall 26 of the rotor 10, is attached to the wear body 40. Two threaded bars 46, 48 (FIG. 4*a*) extend from one end of the mounting plate 44. By means of these two bars 46, 48 the wear tip holder 32 can be mounted to the rotor wall 26 and fixed by nuts 50 (FIG. 2). FIG. 4*b* illustrates the wear tip holder 32 without the threaded bars 46, 48, instead revealing a pair of threaded holes 47, 49 for receiving the threaded bars 46, 48 of FIG. 4*a*. A holding flange 52, extending from the wear body 40 at a distance from and in the same general direction as the mounting plate 44, serves for gripping and holding the rotor wall 26 in a manner which will be illustrated in greater detail in FIG. 5. Referring again to FIGS. 4*a-b*, the mounting plate has a wear face 54 (FIG. 4*a*), which, when the wear tip holder 32 is attached to the rotor wall arrangement 24, faces the interior of the rotor 10, and which is exposed to wear at any location where it is not protected by the bed 36 of material (FIG. 3). The mounting plate 44 also has a mounting face 56 (FIG. 4*b*), which abuts the surface of the rotor wall 26 when the wear tip holder 32 is attached to the rotor wall arrangement 24.

A first side wall segment 58*a*, a second side wall segment 58*b*, and a third side wall segment 58*c* extend between the mounting face 56 and the wear face 54. Together, the side wall segments 58*a-c* form a side wall 58 extending from a position 40*a* of the wear body 40, and back again to the wear body 40 at a position 40*b*, the length of the side wall being defined by the length of its projection on the plane of the mounting face 56. The side wall 58 and the mounting face 56 meet along an edge 60, which is partly chamfered so as to, on each side wall segment 58*a-c*, form a respective chamfered material retention surface 62*a-c*. The material retention surfaces 62*a-c* are inclined in relation to the unchamfered portions of the respective side wall segments 58*a-c*, and are shaped so as to, when the wear tip holder 32 is mounted onto a rotor wall 26, together with the rotor wall 26 form a recess running along the respective side wall segment 58*a-c*. Two portions 64, 66 of the length of the third side wall segment 58*c* are unchamfered so as to maximize the integrity and strength of the threaded holes 47, 49. In the embodiment of FIGS. 4*a-b*, the material retention surfaces 62*a-c* together form an aggregate material retention surface 62 extending along about 80% of the length of the side wall 58. Even though not necessary, it is preferred that the aggregate material retention surface 62 extend along at least about ⅓ of the length of the side wall 58.

Figure 5:
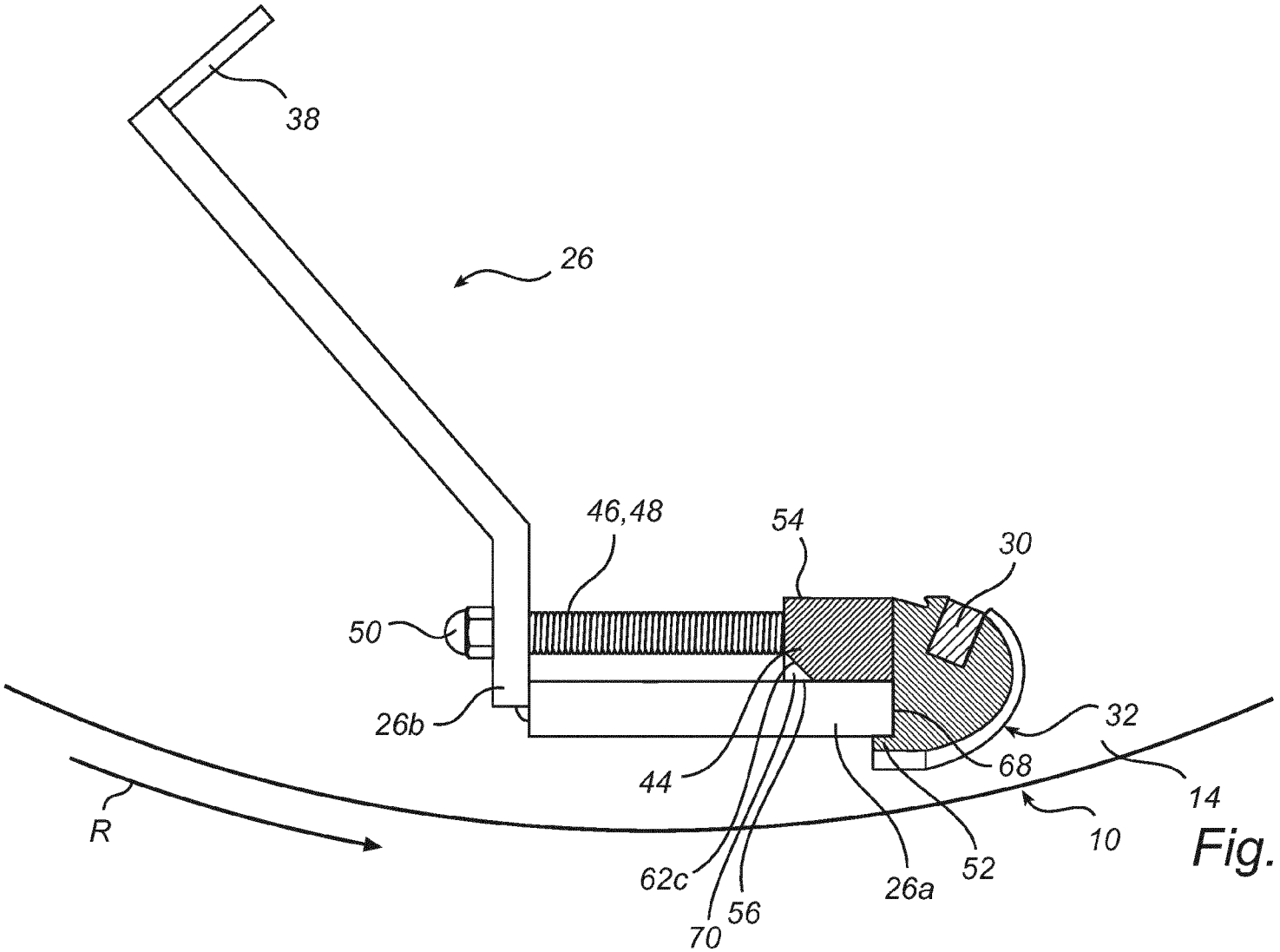
FIG. 5 is a diagrammatic view in section, as seen from above, of a detail of the rotor of FIG. 3 as equipped with the wear tip holder of FIGS. 4*a-b;*

The top view of FIG. 5 illustrates in detail how the wear tip holder 32 is attached to the rotor wall 26. The mounting face 56 of the mounting plate 44 rests on, and abuts, a first segment 26*a* of the rotor wall 26 in such a manner that the holding flange 52 of the wear tip holder 32 grips an edge 68 of the rotor wall 26. The threaded bars 46, 48 penetrate a second segment 26*b* of the rotor wall 26, and nuts 50 are tightened on the threaded bars 46, 48 such that the holding flange 52 firmly grips the edge 68 of the rotor wall 26. The cross-section of FIG. 5 also illustrates a recess 70 formed by a material retention surface 62*c* and the first segment 26*a* of the rotor wall 26. Preferably, the recess 70 is at least 10 mm deep. Even though not illustrated in FIG. 5, it will be appreciated that also the material retention surfaces 62*a-b* (FIG. 4*a-b*) form, together with the rotor wall 26, similar recesses.

Figure 6A:
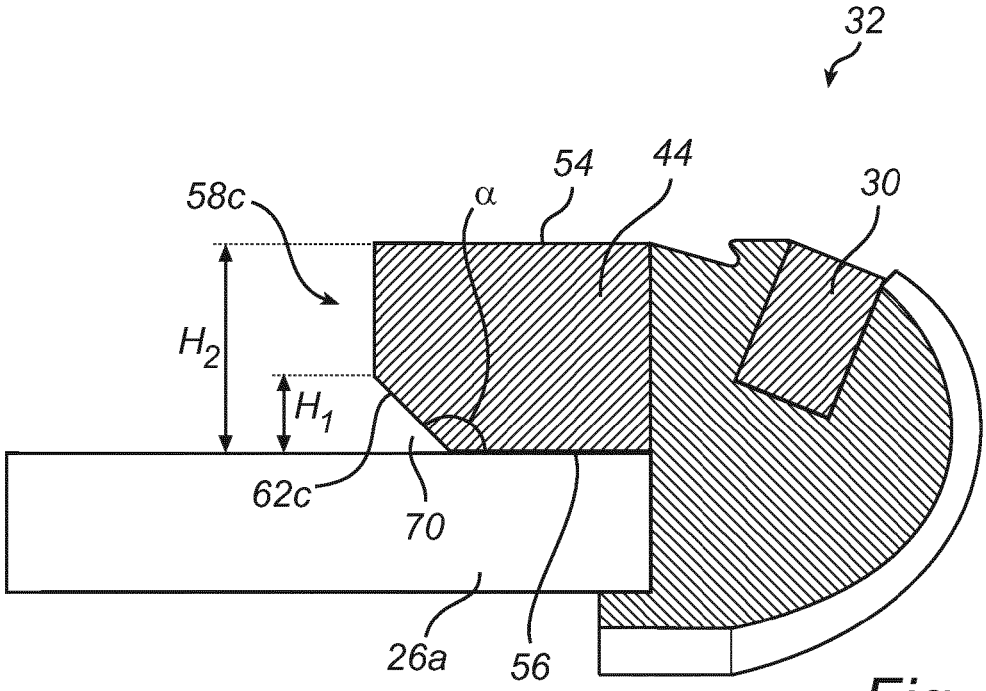
FIG. 6*a* is a diagrammatic view in section, as seen from above, of the wear tip holder of FIGS. 1-5 as mounted onto a rotor wall.

The magnified view of FIG. 6*a* illustrates the mounting plate 44 in greater detail. For reasons of clarity, the threaded bars 46, 48 are not illustrated. The material retention surface 62*c* of the third side wall segment 58*c* faces the first segment 26*a* of the rotor wall 26, and forms an angle α of about 135° with the mounting face 56. Even though any angle α exceeding 90° will assist in maintaining a bed 36 of material on the rotor wall 26, it is preferred that the angle α exceed 100°, and, even more preferred, exceed 120°. From a material trapping point of view it is preferred, though not necessary, that the height H1 of the material retention surface 62*c* over the first segment 26*a* of the rotor wall 26 be at least ⅓ of the total height H2 of the mounting plate 44. It is also preferred, from a durability point of view, that the height H1 of the material retention surface 62*c* over the first segment 26*a* of the rotor wall 26 be less than 80% of the total height H2 of the mounting plate 44, such that the recess 70 does not excessively weaken the wear face 54. The material retention surface 62*c* of FIG. 6*a* faces the first segment 26*a* of the rotor wall 26 directly, i.e. there are no intermediate structures or components between the material retention surface 62*c* and the first segment 26*a* of the rotor wall 26, as seen along a direction normal to the first segment 26*a* of the rotor wall 26.

Even though not illustrated in the cross-section of FIG. 6*a*, also the material retention surfaces 62*a-b* of the first and second side wall segments 58*a-b* are chamfered in the same manner, mutatis mutandis, as the third material retention surface 62*c*.

Figure 6B:
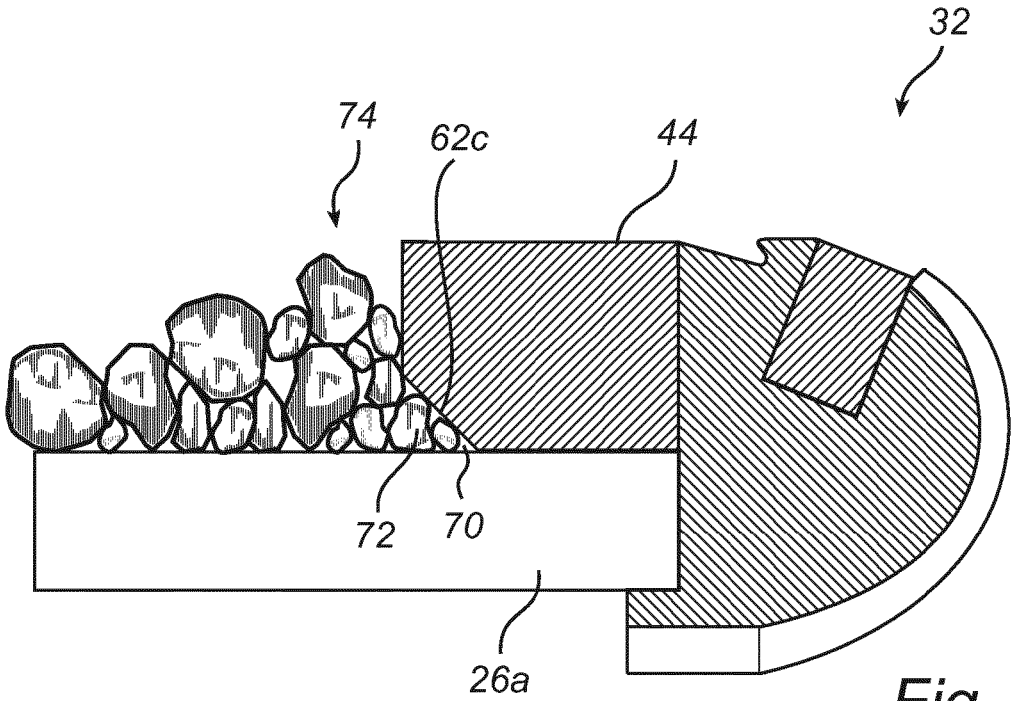
FIG. 6*b* corresponds to the view of FIG. 6*a*, and illustrates the wear tip holder when material to be crushed is present in the crusher.

FIG. 6*b* illustrates the function of the material retention surface 62*c* when material to be crushed is present in the rotor 10. Pieces 72 of material to be crushed are trapped and wedged between the material retention surface 62*c* and the first segment 26*a* of the rotor wall 26. The pieces 72 of material form a rough, structured surface 74 facing the interior of the rotor 10, thereby assisting in preventing the bed 36 of material (FIG. 3) from sliding across the wear tip 30 and leaving the rotor 10.

Figure 7:
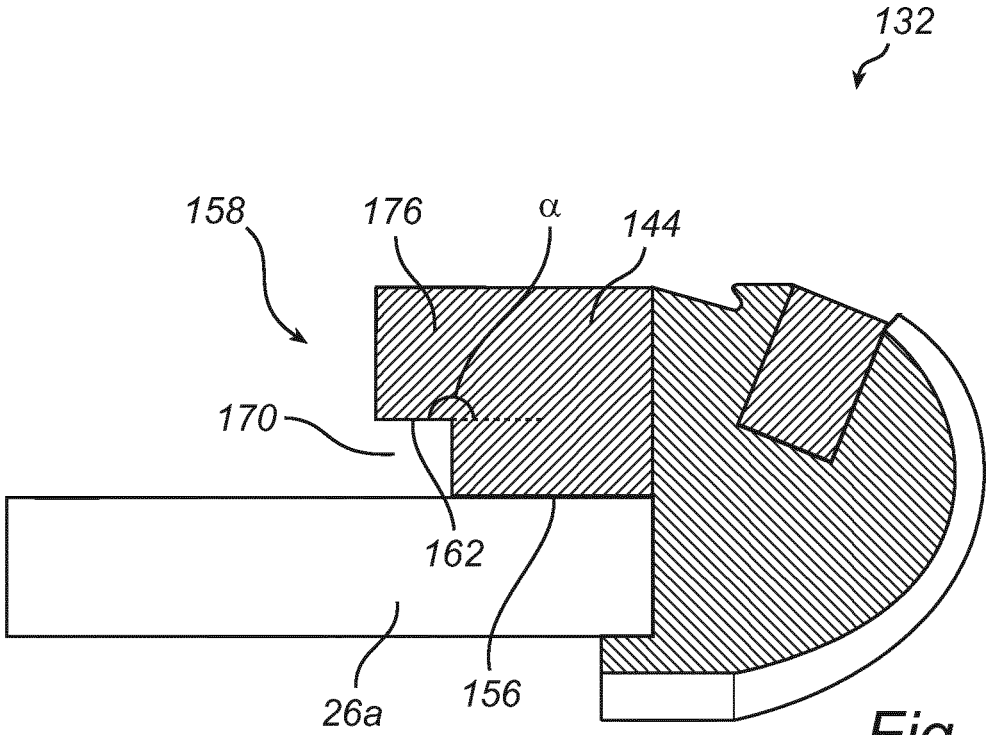
FIG. 7 is a diagrammatic view in section, as seen from above, of a second embodiment of a wear tip holder mounted onto a rotor wall.

FIG. 7 illustrates a second embodiment of a mounting plate 144 of a wear tip holder 132. The mounting plate 144 has a side wall 158 comprising a material retention surface 162. Again, the material retention surface 162 directly faces the rotor wall 26*a* faced by the mounting face 156. In the embodiment of FIG. 7, the material retention surface 162 is parallel to, i.e. forms an angle α of 180° with, the mounting face 156.

The material retention surface 162 may be seen as a chamfering of the side wall 158, or as being formed by a shoulder 176 extending from the side wall 158; this is merely a matter of taste.

Figure 8:
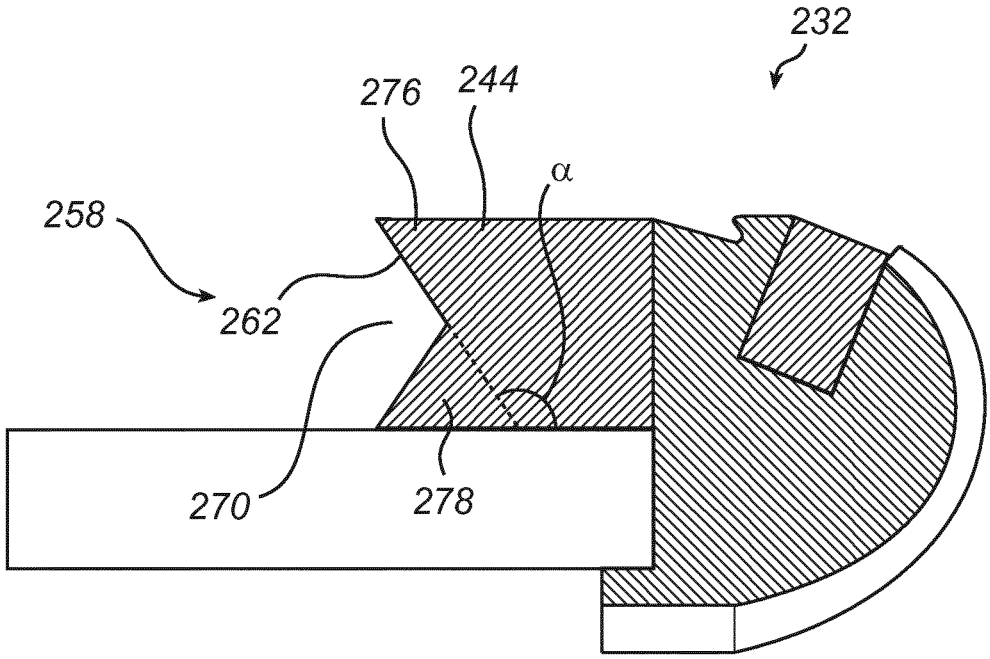
FIG. 8 is a diagrammatic view in section, as seen from above, of a third embodiment of a wear tip holder mounted onto a rotor wall.

FIG. 8 illustrates a third embodiment of a mounting plate 244 of a wear tip holder 232. Again, the mounting plate 244 has a side wall 258 comprising a material retention surface 262. Contrary to the embodiments of FIGS. 1-7, the material retention surface 262 does not face the rotor wall 26*a* directly. Instead, the side wall 258 is provided, as seen in cross-section, with a recess 270, so as to form an upper shoulder 276 having the mounting face 262 facing downwards, towards the first segment 26*a* of the rotor wall 26, and a lower shoulder 278 located between the mounting face 262 and the first segment 26*a* of the rotor wall 26, such that the material retention surface 262 only indirectly faces said first rotor wall segment 26*a*.

Figure 9:
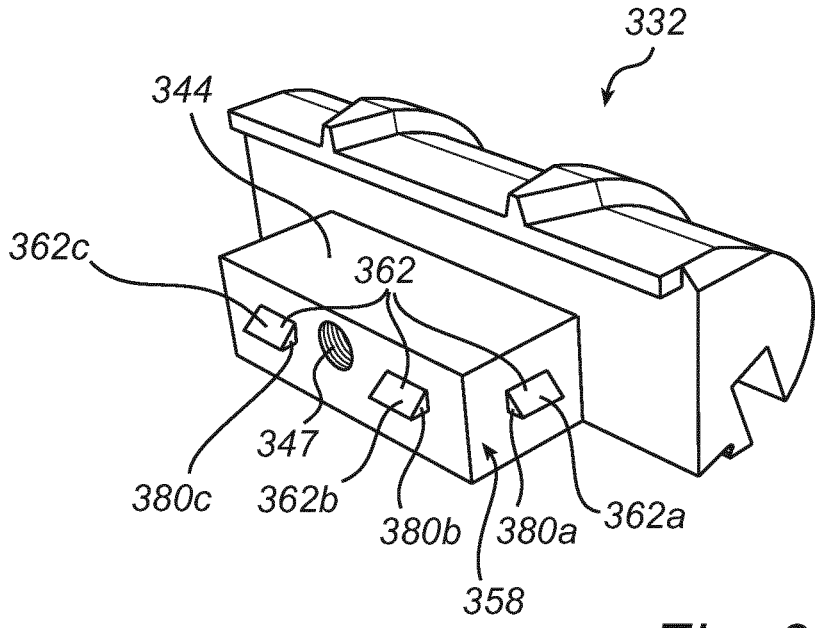
FIG. 9 is a view in perspective of a fourth embodiment of a wear tip holder.

FIG. 9 illustrates, in perspective, a fourth embodiment of a wear tip holder 332 having a mounting plate 344 provided with a material retention surface 362. The material retention surface 362 is formed by a plurality of material retention surface segments 362*a-c*, each being located on a respective material retention dog 380*a-c* projecting from the side wall 358 of the mounting plate 344. It will be appreciated that the side wall 358 may be provided with any suitable number of material retention dogs.

Figure 10:
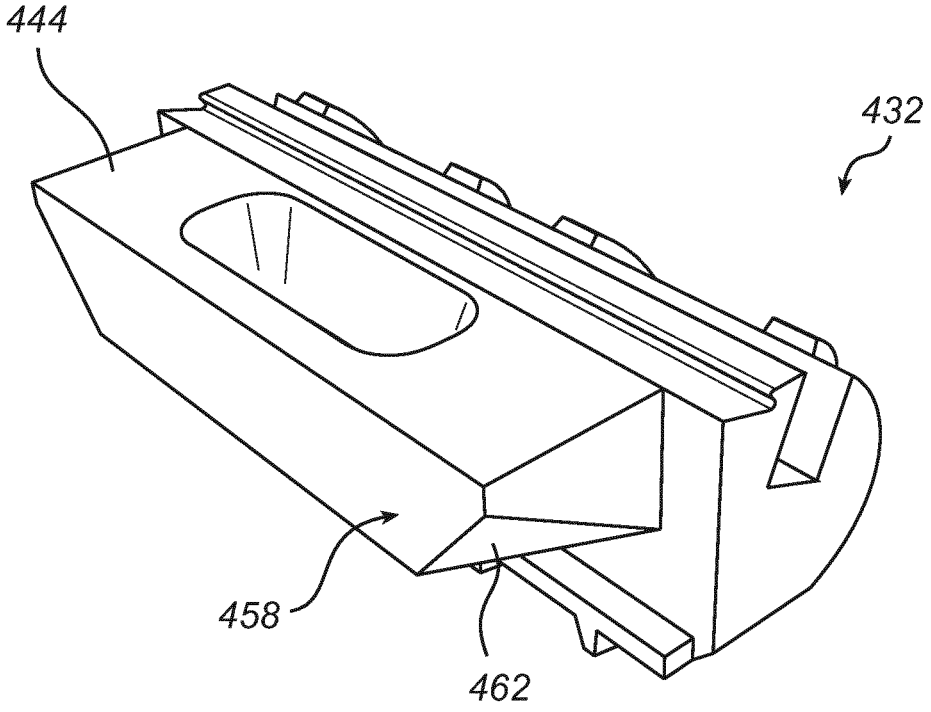
FIG. 10 is a view in perspective of a fifth embodiment of a wear tip holder.

FIG. 10 illustrates, in perspective, a fifth embodiment of a wear tip holder 432 having a mounting plate 444 provided with a material retention surface 462. The material retention surface 462 is formed as an oblique chamfering of the side wall 458 of the mounting plate 444.

Figure 11:
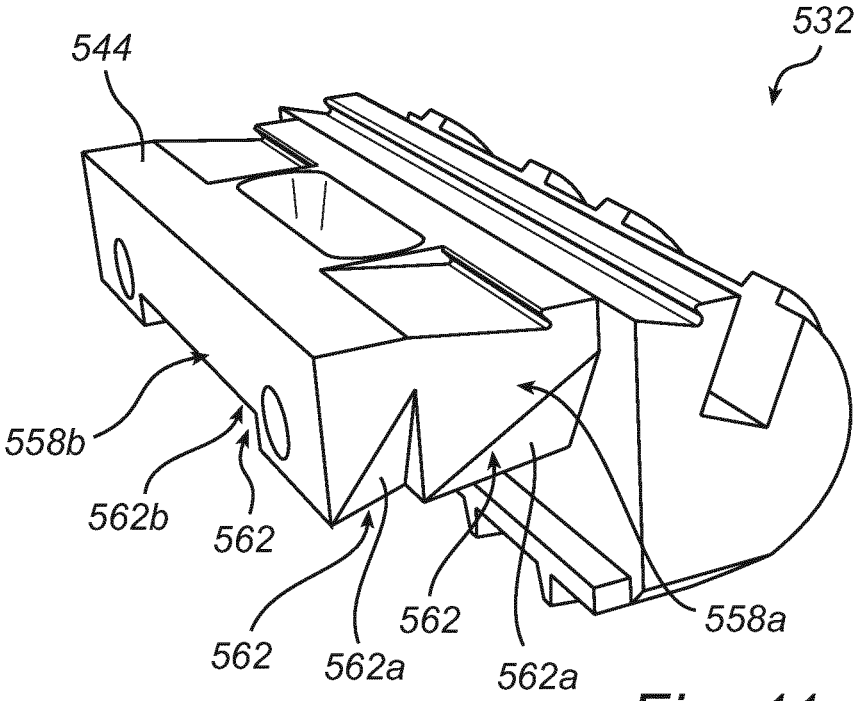
FIG. 11 is a view in perspective of a sixth embodiment of a wear tip holder.

FIG. 11 illustrates, in perspective, a sixth embodiment of a wear tip holder 532 having a mounting plate 544 provided with a material retention surface 562. The material retention surface 562 is formed by a pair of oblique chamferings 562*a* of a first side wall segment 558*a*, and a straight chamfering 562*b* of a second side wall segment 558*b*.

Figure 12:
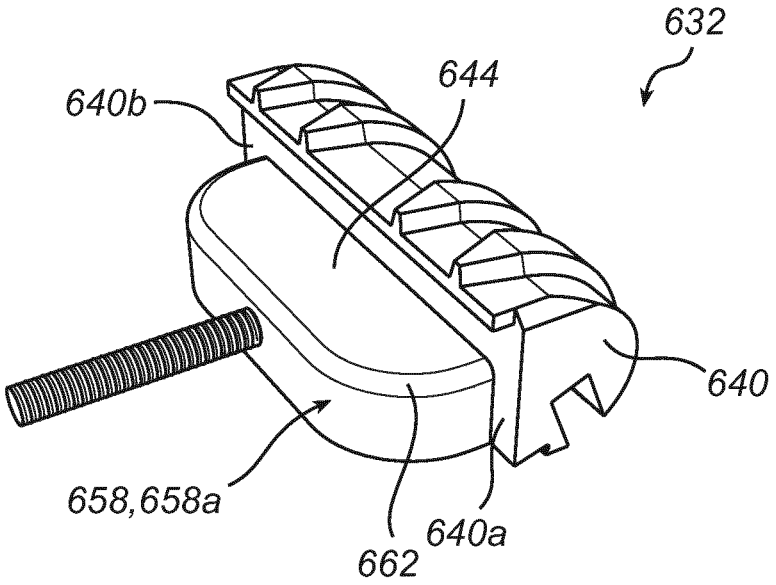
FIG. 12 is a view in perspective of a seventh embodiment of a wear tip holder.

FIG. 12 illustrates, in perspective, a seventh embodiment of a wear tip holder 632 having a mounting plate 644 provided with a material retention surface 662. The wear tip holder of FIG. 12 differs from the wear tip holders of FIGS. 1-11 in that the side wall 658 of the mounting plate 644 consists of only one single, curved side wall segment 658*a* extending from a position 640*a* of the wear body 640, and back again to a position 640*b* of the wear body 640.

Each of the material retention surfaces 62, 162, 262, 362, 462, 562, 662 described in the foregoing may be used for retaining an autogenous wear layer of material to be crushed in the manner described in detail with reference to FIG. 6*b*.

The invention has mainly been described above with reference to a few embodiments. However, as is readily appreciated by a person skilled in the art, other embodiments than the ones disclosed above are equally possible within the scope of the invention as defined by the appended patent claims.

For example, the invention is not limited to any particular number of material retention surface segments on each single mounting plate side wall. Moreover, the invention is not limited to any particular size or shape of the material retention surfaces, since many different sizes and shapes are suitable for holding, when the wear tip holder is in use, material to be crushed. All such embodiments fall within the scope of the appended claims.

The invention claimed is:

1. A vertical shaft impact (VSI) crusher for crushing material, the VSI crusher comprising:

a rotor having a vertical rotor wall, the rotor wall having an outflow opening; and a wear tip holder arranged to hold a wear tip adjacent to the outflow opening of the vertical rotor wall, the wear tip holder including a wear body for holding the wear tip and a mounting plate attached to the wear body for mounting the wear tip holder to said rotor wall, the mounting plate having a mounting face abutting a segment of the rotor wall, a wear face, opposite the mounting face, facing an interior of the rotor, and a side wall extending between said mounting face and said wear face, the side wall including a material retention surface facing the rotor wall segment, the material retention surface and the rotor wall segment forming a recess to trap the material therein.

2. The VSI crusher according to claim 1, wherein at least a portion of the material retention surface is shaped as a chamfering of the side wall.

3. The VSI crusher according to claim 1, wherein at least a portion of the material retention surface forms an angle of more than 100° with the mounting face.

4. The VSI crusher according to claim 1, wherein at least a portion of the material retention surface and the rotor wall segment form the recess, the recess having a depth exceeding 10 mm.

5. The VSI crusher according to claim 1, wherein at least a portion of the material retention surface is shaped as a shoulder extending from the side wall.

6. The VSI crusher according to claim 1, wherein the material retention surface extends along at least ⅓ of the length of the side wall.

7. The VSI crusher according to claim 1, wherein at least a portion of the material retention surface extends over at least ⅓ of the height of the side wall.

8. The VSI crusher according to claim 1, wherein at least a portion of the material retention surface extends to a height of less than 80% of a height of the side wall.

9. The VSI crusher according to claim 1, wherein the material retention surface is arranged to directly face the rotor wall segment.

10. The VSI crusher according to claim 1, wherein the side wall includes three straight side wall segments, each of the side wall segments being provided with the material retention surface facing, when in use, the rotor wall segment.

11. The VSI crusher according to claim 1, wherein the area of the wear face is at least 3% larger than the area of the mounting face.

12. The VSI crusher according to claim 1, wherein said mounting plate is provided with a fastening arrangement for fastening the wear tip holder to the rotor wall, the fastening arrangement being located at an unchamfered portion of the side wall.

* * * * *